United States Patent [19]

von Jordan et al.

[11] 4,416,671

[45] Nov. 22, 1983

[54] METHOD OF OPTIMIZING THE COLLECTION EFFICIENCY OF AN ELECTROSTATIC PRECIPITATOR

[75] Inventors: Wenzel von Jordan, Darmstadt; Franz Neulinger, Dietzenbach, both of Fed. Rep. of Germany

[73] Assignee: Metallgesellschaft AG, Frankfurt am Main, Fed. Rep. of Germany

[21] Appl. No.: 355,038

[22] Filed: Mar. 5, 1982

[30] Foreign Application Priority Data

Mar. 10, 1981 [DE] Fed. Rep. of Germany ..... 3108968

[51] Int. Cl.[3] ..... B03C 3/00

[52] U.S. Cl. ..... 55/4; 55/5; 55/8; 55/10; 55/106; 55/20; 364/551

[58] Field of Search ..... 55/4, 5, 10, 8, 105, 55/139, 106; 364/500, 550, 551

[56] References Cited

U.S. PATENT DOCUMENTS 1,909,825 5/1933 Hahn et al. ..... 55/106
3,704,569 12/1972 Hardison et al. ..... 55/5

FOREIGN PATENT DOCUMENTS 1002626 8/1965 United Kingdom ..... 55/8
480429 12/1975 U.S.S.R. ..... 55/4
567496 8/1977 U.S.S.R. ..... 55/4

*Primary Examiner*—Bernard Nozick
*Attorney, Agent, or Firm*—Sprung, Horn, Kramer & Woods

[57] ABSTRACT

A method of optimizing the collection efficiency of a dry-process electrostatic precipitator which is preceded by an evaporative cooler, wherein liquid is sprayed into the evaporative cooler at a rate which is controllable to maintain a desired temperature includes the steps of intermittently measuring the dew points of acid separately and setting the desired temperature $T_c$ in dependence on the measured dew point of acid and a preselected margin of safety $\Delta T$, in accordance with $T_c = T_s + \Delta T$, determining a desired input current $I_c$ for the electrostatic precipitator at $T_c$ and storing $I_c$, and continuously calculating the deviations of the actual input current I of the precipitator from the desired input current $I_c$ and initiating the measurement of the dew point $T_s$ of acid in response to a predetermined deviation to update the desired temperature $T_c$.

6 Claims, 1 Drawing Figure

METHOD OF OPTIMIZING THE COLLECTION EFFICIENCY OF AN ELECTROSTATIC PRECIPITATOR

BACKGROUND OF THE INVENTION

This invention relates to a method of optimizing the collection efficiency of a dry-process electrostatic precipitator which is preceded by an evaporative cooler, wherein liquid is sprayed into the evaporative cooler at a rate which is controlled so as to maintain a desired temperature.

Electrostatic precipitators are often preceded by an evaporative cooler in order to improve the collection efficiency of a precipitator. The evaporative coolers reduce the gas temperature and exert a desirable influence on the collection of the dust entrained in the gas stream. Besides, the coolers effect a certain preliminary collection of dust because dust particles agglomerate with the sprayed liquid to form larger particles, which are separated by gravity at points of reversal or where the gas velocity is decreased. The dust resistivity is a parameter which influences the collection of the dust in the electrostatic precipitator and often exceeds $10^{11}$ ohm-cm. In that case a collection of dust from a gas by means of an electrostatic precipitator cannot be effected with a reasonable expenditure unless the gas temperature is lowered in order to reduce the dust resistivity below that value (see Z. Technische Mitteilungen, 71, (1978), pages 123 to 131, particularly FIG. 17 on page 127).

The dust resistivity will be lower and the collection efficiency will be higher as the gas temperature decreases. But owing to the risk of corrosion the gas temperature must not decrease below the dew point of acid. For this reason the temperature of a gas stream from which dust is to be collected in an electrostatic precipitator cannot be reduced by means of an evaporative cooler below a lower limit, which depends on various variables and which may fluctuate more or less during operation.

In the design of a dust-collecting plant comprising an evaporative cooler and an electrostatic precipitator it is not sufficient, for the reasons explained above, to measure as exactly as possible the anticipated dew point of acid and to take that anticipated dew point properly into account. For optimizing the collection efficiency and for adjusting the plant in dependence on a varying composition of the gas, the operation of the evaporative cooler must continually be adapted to the actual conditions.

This involves such a great difficulty, that it has not been possible before to reliably and continuously measure the dew point of acid. Because the known devices for measuring the dew point of acid will inevitably be soiled, they are liable to malfunction and require a careful servicing. They must be cleaned virtually after every measurement in order to preclude measuring errors and to ensure a satisfactory function. For this reason automatic measuring devices are highly expensive and complicated and can be used, at best, for an intermittent measurement of the dew point of acid. Such an intermittent measurement cannot be used to control the evaporative cooler with the aim of optimizing the collection efficiency of the electrostatic precipitator. The measured values become available only with long intervals of time and a control system utilizing such measured values could not respond to changes in operating conditions so quickly that corrosion will be reliably avoided. Whereas that risk might be avoided in that an adequate margin of safety from the dew point of acid is maintained in operation, this would prevent an optimizing of the collection efficiency. On the other hand, there may be no changes in the dew point of acid for long periods of operation so that a continuous use of the complicated measuring devices is not justified.

SUMMARY OF THE INVENTION

For this reason it is an object of the invention to improve the method described first hereinbefore so that the evaporative cooler will always be supplied with liquid at the highest possible rate and that a temperature drop below the dew point of acid will reliably be avoided. Besides, a quick response to changes in operating conditions should be ensured and a continuous operation of the measuring device used to measure the dew point of acid should be avoided.

This object is accomplished according to the invention in that the dew point of acid $T_s$ is intermittently measured separately and the desired temperature $T_c$ is automatically set in dependence on said dew point of acid and a margin of safety $\Delta T$, which is determined in accordance with the formula $T_c = T_s + \Delta T$, that the input current $I_c$ of the electrostatic precipitator at $T_c$ is measured and is stored as a desired value for use in an auxiliary controller and that deviations of the actual input current I of the precipitator from the desired input current $I_c$ are represented by control signals for initiating the operation of the measuring device for another measurement of the dew point of acid $T_s$.

This invention is based on the recognition that the input current of the precipitator can be changed by a change of the dew point of acid and can be used as an auxiliary variable, which can be measured and utilized for an automatic control in a manner which meets all of the requirements. As a change of the input current of the precipitator may be due to other causes, it must also be possible to measure the dew point of acid by a device which in the proposed method will be operated only when there is a "suspicion" that the dew point of acid has been changed.

According to a preferred further feature of the invention different thresholds $\Delta I_{hd\,o} = I - I_c$ in the case of a current input above the desired input current $I_c$ and $\Delta I_u = I_c - I$ in the case of an input current below the desired input current $I_c$ for the response of the auxiliary controller are set independently of each other. A rise above $I_c$ by the adjustable amount $\Delta I_o$ is suitably utilized to generate a control signal for a direct action on the feedback controller for the evaporative cooler. The actual input current I of the precipitator is measured as the average value of the input current of the electrostatic precipitator, which input current changes periodically at (twice) the frequency of the power supply system. It is also proposed to generate a control signal in response to a deviation of the actual input current I of the precipitator from the desired input current only if the deviation exceeds the response threshold and has lasted for more than an adjustable minimum time $\Delta t$. Finally, it is intended to use a micro-computer, which is programmed with learning algorithms so that the parameters $\Delta T$, $\Delta I_o$ and $\Delta I_u$ will be minimized.

BRIEF DESCRIPTION OF THE DRAWING

Further details will be explained more fully with reference to the circuit block diagram of FIG. 1.

DETAILED DESCRIPTION OF THE INVENTION

Figure 1:
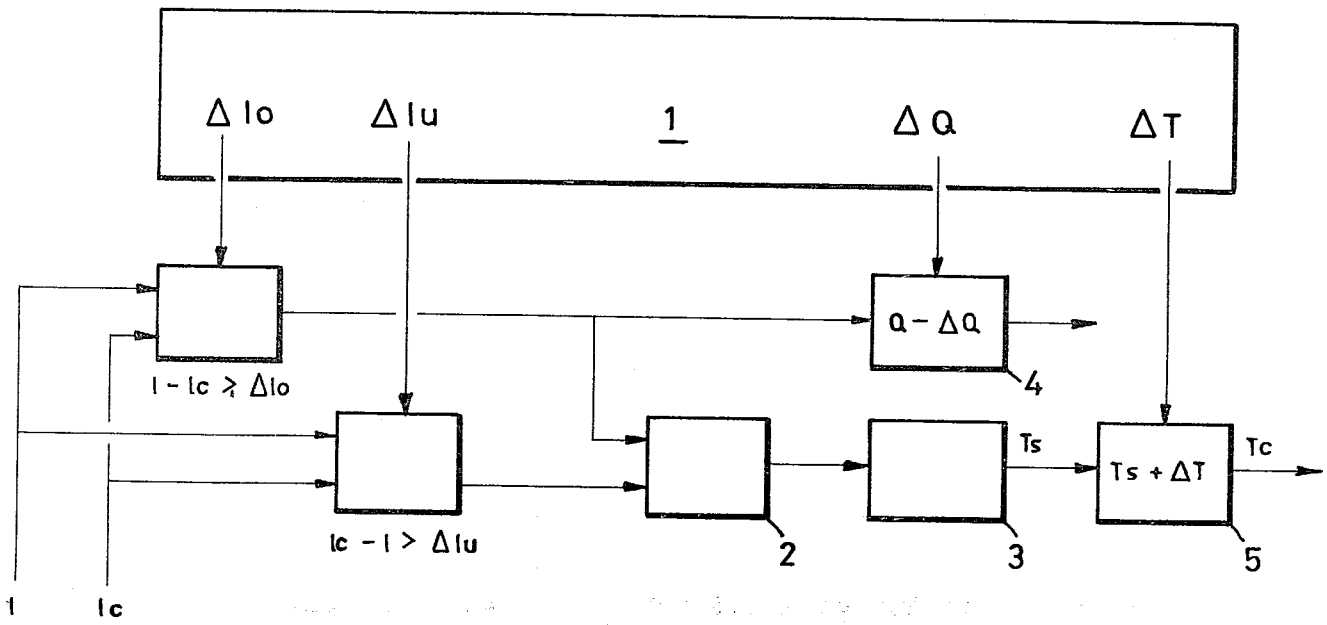

In a plant for collecting dust from gas, comprising an evaporative cooler and an electrostatic precipitator, the rate at which liquid is sprayed into the evaporative cooler is usually controlled so as to maintain a desired temperature. In the operation of an electrostatic precipitator, the input current of the precipitator is at least recorded or is used to control the voltage applied to the precipitator. For this reason the invention is based on the use of existing measuring and control systems in combination with an intermittent measurement of the dew point of acid in order to optimize the collection efficiency. The input terminals for the signals for I and $I_c$ are shown on the left in the circuit diagram. The differences $I-I_c$ and $I_c-I$ are continuously computed to detect the deviation of the actual input current of the precipitator from the desired value. That deviation is compared with $\Delta I_o$ and with $\Delta I_u$, which have both been stored in the microcomputer 1. If the comparison shows the deviation to exceed the adjusted response threshold, a corresponding signal is delivered via OR gate 2 to activate the device 3 for measuring the dew point of acid and if $I_o$ has been exceeded the signal is immediately delivered to the spray rate feedback controller 4 for the evaporative cooler with the result that the spraying rate Q is decreased by $\Delta Q$. As a result, the gas temperature is increased, for the sake of precaution, and a possible risk of corrosion is precluded. When the measurement of the dew point of acid indicates that said dew point has actually increased, a new desired temperature $T_c$, which is determined in consideration of $\Delta T$ also stored in the microcomputer, is automatically determined for the temperature feedback controller 5 for the evaporative cooler. If the rise of the input current of the precipitator was not due to an increase of the dew point of acid, the new dew point of acid which has been measured will not result in a change of the desired temperature $T_c$ from the previous setting and after a temporary decrease of the spraying rate the evaporative cooler will be controlled to maintain the desired temperature $T_c$, regardless of the conrol action which has been due to the rise in excess of $I_o$. An increase in the difference $I_c-I$ in excess of $\Delta I_u$ *may be due to a decrease of the dew point of acid. In that case a direct influence on the control of the evaporative cooler is not required but just as in case of a rise above* $I_o$ the dew point of the acid is measured again and if it has actually decreased, a correspondingly lower desired temperature $T_c$ is set. This means that the evaporative cooler can now be supplied with liquid at a higher rate so that the gas temperature is reduced and the collection efficiency of the electrostatic precipitator is further improved. On the other hand, if it is found that the rise above $\Delta I_u$ is not due to a decrease of the dew point of acid, the previously set value of $T_c$ will be maintained. In any case, each measurement of the dew point of acid, regardless of the result of the measurement, will have the result that the corresponding input current $I_c$ of the electrostatic precipitator is determined as a new set point for comparison with the actual current I of the precipitator, whether or not the desired temperature $T_c$ is changed. This will ensure that the parameter $I_c$ which is used for a quick action of the control system is continually adapted to the operating conditions so that the plant can be operated as closely as possible to the limit which depends on the dew point of acid whereas there is no risk of corrosion.

The actual values for the margin of safety $\Delta T$ and for the response thresholds $\Delta I_o$ and $\Delta I_u$ differ for different dust-collecting plants and must be determined by trial and error in each case. Particularly $\Delta T$ will highly depend on the location at which the dew point of acid is measured in the flue gas stream and on the inevitable losses of heat to the outside from the succeeding parts of the plant. But a provisional determination of $\Delta T$ can easily be made in view of the results of additional measurements, which are usually conducted as a plant is run, and by means of learning algorithms programmed in the microcomputer may subsequently be optimized to the smallest possible value for the particulr plant. Similar remarks are applicable to the parameters $\Delta I_o$ and $\Delta I_u$, which are the response thresholds of the auxiliary controller and can be at least approximately derived from the response of the control system as the plant is run. These parameters will also be optimized during operation although they must not be so small that the control system is no longer stable.

It will be appreciated that the instant specification and claims are set forth by way of illustration and not limitation, and that various modifications and changes may be made without departing from the spirit and scope of the present invention.

What is claimed is:

1. A method of optimizing the collection efficiency of a dry-process electrostatic precipitator which is preceded by an evaporative cooler, wherein liquid is sprayed into the evaporative cooler at a rate Q which is controllable to maintain a desired temperature $T_c$ of an acid containing flue gas stream which is passed through the evaporative cooler and electrostatic precipitator, comprising the steps of:

(a) intermittently measuring the acid dew point $T_s$ of the flue gas stream downstream of the evaporative cooler and setting the desired temperature $T_c$ in dependence on the measured acid dew point $T_s$ and a preselected margin of safety $\Delta T$, in accordance with $T_c=T_s+\Delta T$, (b) determining a desired input current $I_c$ for the electrostatic precipitator at the temperature $T_c$ and storing $I_c$, and (c) continuously obtaining the deviations of the actual input current I of the precipitator from the desired input current $I_c$ and initiating the measurement of the acid dew point $T_s$ in response to a predetermined deviation $\Delta I$ to update the desired temperature $T_c$.

2. The method according to claim 1, wherein the deviations of the actual input current I of the precipitator are continuously obtained as the average value of the input current of the electrostatic precipitator measured periodically at twice the frequency of the power supply system.

3. The method according to claim 1, wherein the step of initiating the measurement of the acid dew point $T_s$ comprises the steps of selecting thresholds $\Delta I_o=I-I_c$ for an input current above the desired input current $I_c$ and $\Delta I_u=I_c-I$ for an input current below the desired input current $I_c$ and wherein the thresholds are set independently of each other.

4. The method according to claim 3, wherein the step of initiating the dew point measurement is conditional upon exceeding the threshold $\Delta I_o$, $\Delta I_u$ for more than a preselected minimum time $\Delta t$.

5. The method according to claim 3, further comprising temporarily decreasing the rate Q at which liquid is sprayed into the cooler by a preselected value $\Delta Q$ when $I-I_c>\Delta I_o$ until the dew point measurement has been completed.

6. The method according to claim 5, further comprising minimizing the parameters $\Delta T$, $\Delta I_o$ and $\Delta I_u$ during operation of the method.

* * * * *